US005263308A

United States Patent [19]

Lee et al.

[11] Patent Number: 5,263,308

[45] Date of Patent: Nov. 23, 1993

[54] METHOD FOR PLY-TWISTING YARNS HAVING LOW LEVELS OF FINISH

[75] Inventors: Davis E. Lee, Greenville, N.C.; Peter M. Murphy, Seaford, Del.

[73] Assignee: E. I. Du Pont de Nemours and Company, Wilmington, Del.

[21] Appl. No.: 843,121

[22] Filed: Feb. 28, 1992

[51] Int. Cl.[5] ..... D06M 15/00; D01H 7/90; D01H 13/04; D02G 3/02

[52] U.S. Cl. ..... 57/241; 57/292; 57/58.3; 252/8.6; 252/8.9

[58] Field of Search ..... 57/58.3, 236, 241, 282, 57/292; 252/8.6, 8.9

[56] References Cited

U.S. PATENT DOCUMENTS

| | | | |
|---|---|---|---|
| 2,109,947 | 3/1938 | North | 260/103 |
| 2,803,646 | 8/1957 | Bell et al. | 260/484 |
| 2,914,903 | 12/1959 | Klein | 57/58.3 X |
| 3,065,592 | 11/1962 | Kresslein | 57/108 |
| 3,094,835 | 6/1963 | Nimtz et al. | 57/106 |
| 3,907,689 | 9/1975 | Carver | 252/8.7 |
| 3,951,825 | 4/1976 | Carver | 252/8.7 |
| 3,970,569 | 7/1976 | Sturwold et al. | 252/49.3 |
| 4,098,702 | 7/1978 | Crossfield et al. | 252/8.6 |
| 4,163,114 | 7/1979 | Koleske et al. | 560/186 |
| 4,163,357 | 8/1979 | Greive et al. | 57/58.3 X |
| 4,388,372 | 6/1983 | Champaneria et al. | 428/395 |
| 4,403,049 | 9/1983 | Murase et al. | 523/455 |
| 4,505,956 | 3/1985 | Yamamoto et al. | 427/393.1 |
| 4,615,816 | 10/1986 | Ogiso et al. | 252/8.9 |
| 4,766,153 | 8/1988 | Casciari et al. | 514/785 |
| 4,789,381 | 12/1988 | Oshiyama et al. | 252/8.6 X |
| 4,859,350 | 8/1989 | Gillberg-LaFore et al. | 252/8.6 X |
| 4,871,592 | 10/1989 | Lowenstein et al. | 252/8.6 X |
| 4,957,648 | 9/1990 | Yodice et al. | 252/8.6 |

FOREIGN PATENT DOCUMENTS 1094071 1/1965 United Kingdom .

OTHER PUBLICATIONS

Canadian Textile Journal, Polejes, J. D., "Principles of Cable Twister Design & Operation", Sep. 1984, pp. 56-65.

*Primary Examiner*—Arthur C. Prescott

[57] ABSTRACT

This invention relates to an improved method for ply-twisting nylon yarns at twisting speeds greater than 6000 rpm. More particularly, the invention involves coating the nylon fibers with less than about 1% by weight of finish containing an alkyl polyoxyalkylene carboxylate ester lubricant composition. The resulting ply-twisted yarn is especially suitable for use as pile in carpets.

14 Claims, 1 Drawing Sheet

METHOD FOR PLY-TWISTING YARNS HAVING LOW LEVELS OF FINISH

BACKGROUND OF THE INVENTION

1. Field of the Invention

This invention relates to an improved method for ply-twisting nylon yarns at twisting speeds greater than 6000 rpm. More particularly, the invention involves coating the nylon fibers with less than about 1% by weight of finish containing an alkyl polyoxyalkylene carboxylate ester lubricant composition. The resulting ply-twisted yarn is especially suitable for use as pile in carpets.

2. Description of the Related Art

Typical carpets used in residences include loop pile and cut pile carpets. These carpets are made by inserting heat-set, ply-twisted pile yarn into a backing material. For loop pile carpets, the loops are not cut. For cut pile carpets, which are more common, the loops are cut to form substantially parallel vertical tufts.

The yarns which are used in such carpets are prepared by cable-twisting, or ply-twisting, two yarns together, and heat-setting them in their twisted condition. Problems in ply-twisting such yarns are discussed in Polejes, J. D., "Principles of Cable Twister Design and Operation", *Canadian Textile Journal*, September 1984, pp. 56–65.

Generally, a conventional apparatus for ply-twisting the yarns includes a means for feeding one yarn vertically upward from a stationary yarn supply package, located in a yarn supply bucket, and rotating another yarn around the first to form a twisted, combined yarn. The path of the rotating yarn is known as a "balloon". A guide, such as a fixed ring or jacket, is used for guiding and restricting the yarn in the balloon. As the yarn travels in the balloon, it comes into physical contact with the guide. These guides, or limiters, provide a means for controlling or limiting the extent and tension of the yarn in the balloon and are discussed in more detail in such patents as, Kresslein, U.S. Pat. No. 3,065,592, Nimtz et al., U.S. Pat. No. 3,094,835, and U.K. Patent 1,094,071.

A significant problem in using such conventional balloon guides is the high degree of friction created between the guides and the yarn in the balloon. While wind-up speeds are about 100 meters/minute, the speed of the threadline traversing the balloon limiter can exceed 10,000 meters/minute. This high speed contact between the balloon limiter and yarn results in generating polymer dust, broken filaments, deposits on the limiter, and irregular tension or breaks of the entire yarn. Furthermore, these problems become more pronounced as twisting speeds are raised to attain greater productivity of the twisting equipment.

Thus, a conventional solution for ply-twisting nylon bulked continuous filament (BCF) yarns has been developed. This process involves running the twisting equipment at a speed of at least about 6000 rpm, and applying sufficient finish to the supply yarns, so that the frictional problems with the balloon limiters are suppressed. The nylon yarns are coated with greater than 1% finish by weight, applied in either a one-step or two-step process.

In a one-step process, the total finish ("primary" or "spin" finish) is applied to the fibers during spinning, just after the fibers have substantially cooled and prior to such processes as drawing, crimping, wind-up, etc. In a two-step process, finish "A" (primary finish) is applied as in the one-step process, and finish "B" (secondary finish), which may be identical in composition to finish "A", is applied to the fibers after further processing such as drawing, crimping, etc., but before twisting.

These fiber finishes are normally composed of a mixture of lubricants and other chemical substances which impart specific properties to the fiber. Typical additives include, e.g., antistatic agents, antioxidants, and UV stabilizers. Emulsifiers are also often added in order to provide a stable finish which may more easily be applied to the fiber. Specific examples of conventional finishes used for ply-twisting nylon BCF yarns include emulsified coconut oil as disclosed in Champaneria et. al., U.S. Pat. No. 4,338,372, or water soluble lubricants, such as Methoxy PEG 400 Monopelargonate, available from Henkel Corp., as "Emery" 6724.

However, the application of such high amounts of finish is costly, and its presence on the yarn creates problems for the yarn user. If the carpet is washed as part of a dyeing or scouring process, the presence of the finish ingredients creates an environmental problem in the waste water disposal system of the carpet maker's locality. If the carpets are not washed as part of the carpet manufacturing process, the finish remains on the yarn, attracting and holding dirt.

In view of current environmental and economic concerns, it would be highly desirable to discover a method for ply-twisting nylon yarn satisfactorily on conventional twisting equipment having a speed greater than about 6000 rpm, without the need for conventional finish levels.

SUMMARY OF THE INVENTION

The present invention relates to an improved process for ply-twisting nylon bulked continuous filament (BCF) yarns. The process involves applying from about 0.3 to about 1.0% by weight of a finish oil containing certain alkyl polyoxyalkylene carboxylate ester compounds to a nylon BCF yarn. The finish coating may be applied as a component in a primary (spin) finish, or in a secondary (overlay) finish, or in both a primary and a secondary finish. The desired alkyl polyoxyalkylene carboxylate esters are selected from those having the general formula:

$$R_1-O-X_n-(CH_2)_m-\overset{\overset{\displaystyle O}{\|}}{C}-O-R_2 \qquad (I)$$

where, $R_1$ is an alkyl chain from 12 to 22 carbon atoms;

n is 3 to 7; m is 1 to 3;

X is $-C_2H_4O-$ or a mixture of $-C_2H_4O-$ and $-C_3H_6O-$; and $R_2$ is an alkyl chain from 1 to 3 carbon atoms.

Generally, the ply-twisting process involves feeding a creel yarn through a tensioning device and onto a storage disc rotating at a speed of at least about 6000 rpm, whereby the yarn emerges from the disc and forms a balloon. The yarn in the balloon then contacts a balloon limiter as the yarn passes from a disc to a guide. A bucket nylon yarn is fed through a separate tensioning device, where the creel yarn exits from the balloon and wraps around the bucket yarn to form a ply-twisted yarn. Preferably, the creel yarn is fed through a series of low-friction guide rollers prior to passing onto the storage disc.

The BCF yarns coated with the desired alkyl polyoxyalkylene carboxylate esters may be the creel and/or bucket yarn.

In a preferred embodiment, the nylon BCF yarns are coated with less than about 0.7% by weight of a finish oil containing one or more alkyl polyoxyalkylene carboxylate esters of general formula (I), where $R_1 = C_{16}$ to $C_{18}$ alkyl, n is 5, m is 1, X is $—C_2H_4O—$, and $R_2$ is methyl, and the speed of the storage disc is at least about 7,000 rpm. Suitable nylon BCF yarns include, for example, nylon 6,6 and nylon 6. The invention also encompasses yarns made by the process of this invention.

DETAILED DESCRIPTION OF THE INVENTION

Figure 1:
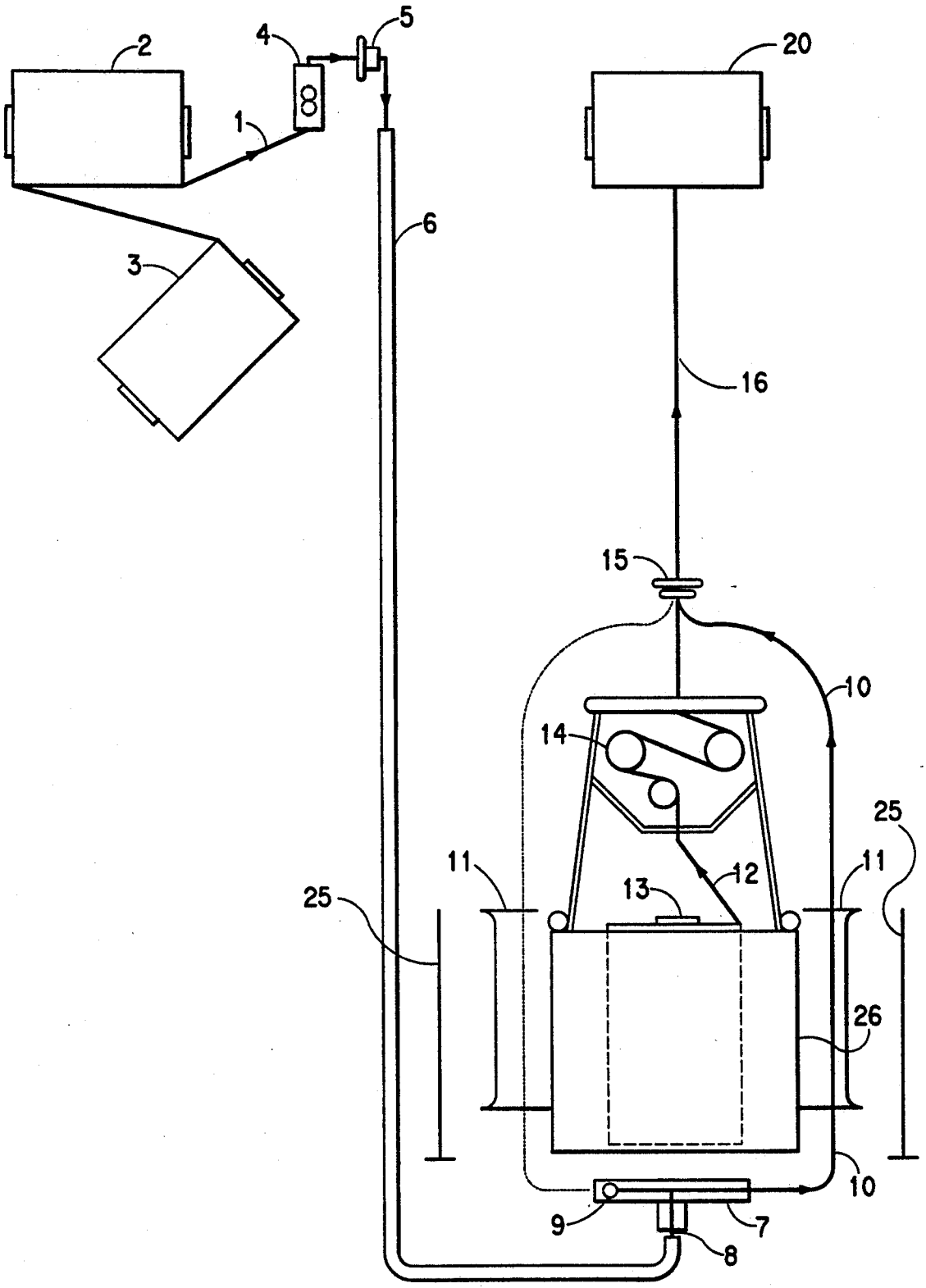
FIG. 1 is a schematic view of the process of the present invention, where nylon bulked continuous filament (BCF) yarns are ply-twisted.

The present invention relates to a process for ply-twisting nylon BCF yarns coated with finishes containing certain lubricant compositions.

Referring to FIG. 1 showing the process of this invention, creel yarn (1) is taken from active creel package (2) through tensioner (4) which may be of any suitable type, through guide (5) and J tube (6) to storage disc (7). Storage disc (7) rotates around its vertical axis while yarn (1) enters disc (7) at point (8), progresses upwardly along the axis, and then exits radially through hole (9). Yarn (1) then wraps up to several turns on the exterior periphery of disc (7), forming a reserve of yarn. Eventually, yarn (1) is flung off by centrifugal force to form balloon (10). The yarn in the path of the balloon then strikes balloon limiter (11) which confines the yarn as it passes from the disc to guide (15). Simultaneously, bucket yarn (12) feeds from stationary package (13), located in supply yarn bucket (26), through tensioner (14) (usually a disc tensioner) to guide (15) where creel yarn (1) in balloon (11) wraps around it. The resulting ply-twisted yarn (16) is then wound on package (20). At any given storage disc speed, the speed of wound package (20) on the wind-up roll (not shown) determines the number of turns per inch of ply-twist which is produced. The tensions of creel yarn (1) and bucket yarn (12) are preferably adjusted to be substantially the same in order to obtain a plied yarn product having balanced twist. Otherwise, the yarn under higher tension forms a straight "core" around which the low tension end wraps. These yarn tensions may be balanced by techniques known in the art.

Reserve yarn package (3) in the creel (not shown) is connected to the transfer tail of yarn from active creel package (2), so that there is no interruption of the twist plying process when package (2) runs out. However, the process must be interrupted for changing bucket stationary package (13). The yarn wrapped on the exterior surface of the storage disc is a reserve which pays out when creel yarn (1) snags coming off the supply package, in the tensioner, or other part of the yarn path, to reduce the sudden tension application which might otherwise break the yarn.

When the process is adjusted for maximum productivity, the yarn in balloon (10) continually rubs against balloon limiters (11). This and other sources of friction in the creel yarn path such as guide (5), J tubes (6) and the passages within disc (7) require the yarn to be lubricated with materials known as finish oils containing certain lubricant compounds to a degree which insures satisfactory operation without yarn or filament breaks.

The key improvement of the present invention is applying a finish oil comprising a lubricant compound having the general formula:

$$R_1—O—X_n—(CH_2)_m—\overset{\overset{\displaystyle O}{\|}}{C}—O—R_2 \qquad (I)$$

where, $R_1$ is an alkyl chain from 12 to 22 carbon atoms;

n is 3 to 7; m is 1 to 3;

X is $—C_2H_4O—$ or a mixture of $—C_2H_4O—$ and $—C_3H_6O—$; and $R_2$ is an alkyl chain from 1 to 3 carbon atoms.

The alkyl chains $R_1$ and $R_2$ include unsaturated, branched, or both unsaturated and branched configurations. However, $R_1$ and $R_2$ are preferably saturated, straight chain configurations due to their generally enhanced biodegradability and lightfastness.

It is understood that each "n" in the composition represented by the above structural formula (I) describes an average number of oxyalkylene units per alcohol molecule. The variation in the number of oxyalkylene moieties is not critical as long as the average is within the limits described.

As described in Casciani, U.S. Pat. No. 4,766,153, certain alkyl polyoxyalkylene carboxylate ester compounds are known and may be used for such purposes as emollients in skin care compositions.

However, the lubricant compounds which are suitable for use in this invention represent a very distinct group of compounds. Although there are numerous compounds having the above chemical structure (I) where the number of ethoxy groups present is greater than 7, it has been found that those compounds having no greater than 7 ethoxy groups are desirable for coating yarns in the high speed ply-twisting operation of this invention.

The lubricants of this invention are water-soluble and may be applied to the nylon BCF yarns either neat (non-aqueous) or, preferably, from an aqueous finish emulsion or solution. The advantages of aqueous finishes are well known in the art and include better temperature control, lower viscosity, and better finish uniformity on the fiber. The finish may be applied to the fiber by a number of common methods including metered application, dip bath, or kiss roll.

In most commercial ply-twisting operations, twisting speeds greater than 6000 rpm are desirable. Thus, in the past, it has been usually necessary to apply a high level of lubricant to the yarns in order to avoid frictional problems with the balloon limiters and other pieces of twisting equipment. Surprisingly, it has now been found that only a small amount of the lubricant compound characterized by the above formula (I) is needed to coat the nylon BCF yarns in the process of this invention. More particularly, the yarns may be coated with about 0.3 to about 1.0% and preferably less than about 0.7% by weight of a finish oil comprising the above-described compound or a mixture of such compounds. As used herein, it is understood that the finish oil may also contain additives typically found in a finish formulation, such as antistatic agents, antioxidants, UV stabilizers, etc.

In accordance with this invention, there are several advantages realized by applying such a low level of lubricant to the yarn.

Carpets composed of lubricant coated yarns are typically washed during a dyeing or scouring process at a carpet mill. Naturally, the effluent streams created by these mills will tend to have lower concentrations of lubricant if yarns having a low level of lubricant are used in the twisting operation.

In conjunction with other factors, the costs associated with applying a specific lubricant to the yarns are generally in direct proportion to the amount of lubricant applied.

The harmful effects often associated with applying lubricants, such as decrease in soil repellency, toxic fumes, and changes of color in the yarn may be reduced in direct proportion to the amount of lubricant applied.

The present invention also permits yarns having less than about 1% by weight of finish oil to be twisted at higher speeds than yarns coated with less than 1% of certain known finish oils. It should be recognized that at such twisting speeds, e.g., 8000 rpm, the yarn in the balloon has higher tension, the tension being proportional to yarn denier and the square of disc speed. In turn, these higher speeds require higher energy. Therefore, the optimum speed will be a balance between the productivity of the process and the cost of power.

Furthermore, the lubricants of this invention are water-soluble, and thus offer several advantages over non-water soluble lubricants, such as coconut oil. For instance, water-soluble lubricants may be applied more uniformly to the fiber. Also, fibers coated with water-soluble lubricants tend to exhibit better soiling performance and dyeing properties, since these lubricants may be easily washed-off during a dyeing or scouring process.

The lubricant compositions used in the process of this invention may be synthesized by a number of different methods, some of which have been described in the literature and others of which are apparent to those skilled in the art.

Method I

As described in the aforementioned patent, Casciani, U.S. Pat. No. 4,766,153, the compounds of formula (I) may be generally prepared by reacting an alcohol having from 12 to 22 carbons with ethylene oxide (or a mixture of ethylene oxide and propylene oxide) to form an alkoxylated alcohol, as shown below in step (a), where X is $-C_2H_4O-$.

$$\text{(a)}\ R_1-OH + C_2H_4O \rightarrow R_1-O-X_n-OH$$

The alkoxylated alcohol is then carboxylated by reaction with a monochlorocarboxylic acid to form an ether carboxylic acid, as shown below in step (b).

$$\text{(b)}\ R_1-O-X_n-OH + Cl-(CH_2)_m-\overset{O}{\overset{\|}{C}}-OH \longrightarrow R_1-O-X_n-(CH_2)_m-\overset{O}{\overset{\|}{C}}-OH$$

The ether carboxylic acid is then esterified by reaction with an alcohol having from 1-3 carbons to form the desired alkyl polyoxyalkylene carboxylate esters, as shown below in step (c).

$$\text{(c)}\ R_1-O-X_n-(CH_2)_m-\overset{O}{\overset{\|}{C}}-OH + R_2-OH \longrightarrow R_1-O-X_n-(CH_2)_m-\overset{O}{\overset{\|}{C}}-O-R_2 \quad (I)$$

Method II

The compounds, $$R_1-O-X_n-(CH_2)_m-\overset{O}{\overset{\|}{C}}-OH,$$

where m=1, may also be prepared by oxidation of $R_1-O-X_n-CH_2CH_2-OH$ according to a number of known routes. These compounds can be easily esterified as shown in step (c) of Method I, to form the desired lubricants.

Method III

In an alternative process, steps (b) and (c) from Method I can be combined as follows:

$$R_1-O-X_n-OH + Cl-(CH_2)_m-\overset{O}{\overset{\|}{C}}-O-R_2 \longrightarrow R_1-O-X_n-(CH_2)_m-\overset{O}{\overset{\|}{C}}-O-R_2 \quad (I)$$

The monochlorocarboxylic acid esters are well known and react like the corresponding monochlorocarboxylic acids.

As with any multi-step organic synthetic process, the order of reactions can be altered to obtain the same resulting compounds. Often the optimum order of reactions is dictated by overall cost, yield, and purity.

TESTING METHODS

Yarn Finish

The amount of finish oil on the yarn was determined by extracting a known weight of yarn with a solvent such as tetrachloroethylene, and then analyzing the extract using an infrared spectrophotometer, and comparing the infrared absorbance of the extract to the absorbance of previously prepared standardized solutions that contain known amounts of finish in the solvent.

The following examples further illustrate the present invention but should not be construed as limiting the scope of the invention.

EXAMPLES

In each of the following examples, 1410 denier Du Pont type 696AS bulked continuous filament (BCF) nylon carpet yarn was used as the both the creel and bucket yarn on a wide-gauge Volkmann twister (Model No. VTS 050 C). In each of these examples, the finish was applied to the yarn in two stages. About 0.30% to about 0.35% by weight of a conventional primary (spin) finish for nylon BCF yarns was used as the primary finish. The type of secondary finish oil for each yarn sample is described below.

Comparative Example A

In this comparative example, 1410 denier Du Pont type 696AS BCF nylon carpet yarn was prepared with a secondary finish of emulsified coconut oil as disclosed in Champaneria et al., U.S. Pat. No. 4,338,372. The levels of secondary (overlay) finish oil (II FOY) were measured on two separate yarn samples and were respectively found to be about 0.5% and about 0.3% based on the weight of fiber. The wide-gauge Volkmann twister was run at 7000 and 8000 rpm storage disc speed for a few hours. Observations made during the ply-twisting operation are reported in Table 1.

Comparative Example B

In this comparative example, 1410 denier Du Pont type 696AS BCF nylon carpet yarn was prepared with a secondary finish of Methoxy PEG 400 Monopelargonate, available from Henkel Corp., as "Emery" 6724. The levels of secondary (overlay) finish oil (II FOY) were measured on two separate yarn samples and were respectively found to be about 0.5% and about 0.3% based on the weight of fiber. The wide-gauge Volkmann twister was run at 7000 and 8000 rpm storage disc speed for a few hours. Observations made during the ply-twisting operation are reported in Table 1.

TABLE 1

(OBSERVATIONS DURING PLY-TWISTING)

| COMPARATIVE SAMPLE | | TWISTING SPEED @ 7000 rpm | TWISTING SPEED @ 8000 rpm |
|---|---|---|---|
| Ex. A | II FOY 0.3% | no deposits | dusty deposits |
| Ex. B | II FOY 0.3% | dusty deposits | dusty deposits |
| Ex. A | II FOY 0.5% | no deposits | dusty deposits |
| Ex. B | II FOY 0.5% | dusty deposits | dusty deposits |

None of the comparative samples resulted in broken filaments in the twisted package.

Comparative Example C

In this comparative example, 1410 denier Du Pont type 696AS BCF nylon carpet yarn was prepared with a secondary finish of an alkyl polyoxyalkylene carboxylate ester of the formula:

$$R_1-O-X_n-(CH_2)_m-\overset{\overset{\displaystyle O}{\|}}{C}-O-R_2$$

where, $R_1$ was a mixture of $C_8$ and $C_{10}$ alkyl, X was $-C_2H_4O-$, n was 9, m was 1, and $R_2$ was methyl. The level of secondary (overlay) finish oil on the yarn (II FOY) was about 0.5% based on the weight of fiber. The wide-gauge Volkmann twister was run at 8000 rpm storage disc speed for a few hours. Observations made during the ply-twisting operation are reported in Table 2.

Comparative Example D

In this comparative example, 1410 denier Du Pont type 696AS BCF nylon carpet yarn was prepared with a secondary finish of an alkyl polyoxyalkylene carboxylate ester of the formula:

$$R_1-O-X_n-(CH_2)_m-\overset{\overset{\displaystyle O}{\|}}{C}-O-R_2$$

where, $R_1$ was $C_8$ alkyl, X was $-C_2H_4O-$, n was 12, m was 1, and $R_2$ was methyl. The level of secondary (overlay) finish oil on the yarn (II FOY) was about 0.3% based on the weight of fiber. The wide-gauge Volkmann twister was run at 8000 rpm storage disc speed for a few hours. Observations made during the ply-twisting operation are reported in Table 2.

Comparative Example E

In this comparative example, 1410 denier Du Pont type 696AS BCF nylon carpet yarn was prepared with a secondary finish of an alkyl polyoxyalkylene carboxylate ester of the formula:

$$R_1-O-X_n-(CH_2)_m-\overset{\overset{\displaystyle O}{\|}}{C}-O-R_2$$

where, $R_1$ was $C_{13}$ alkyl, X was $-C_2H_4O-$, n was 8.5, m was 1, and $R_2$ was methyl. The level of secondary (overlay) finish oil on the yarn (II FOY) was about 0.5% based on weight of fiber. The wide-gauge Volkmann twister was run at 8000 rpm storage disc speed for a few hours. Observations made during the ply-twisting operation are reported in Table 2.

TABLE 2

(OBSERVATIONS DURING PLY-TWISTING)

| COMPARATIVE SAMPLE | | TWISTING SPEED @ 8000 rpm |
|---|---|---|
| Ex. C | II FOY 0.5% | broken filaments & deposits |
| Ex. D | II FOY 0.3% | broken filaments & deposits |
| Ex. E | II FOY 0.5% | broken filaments & deposits |

EXAMPLE 1

In this example, 1410 denier Du Pont type 696AS BCF nylon carpet yarn was prepared with a secondary finish of an alkyl polyoxyalkylene carboxylate ester of the formula:

$$R_1-O-X_n-(CH_2)_m-\overset{\overset{\displaystyle O}{\|}}{C}-O-R_2 \qquad (I)$$

where, $R_1$ was $C_{18}$ alkyl, X was $-C_2H_4O-$, n was 5, m was 1, and $R_2$ was methyl. The level of secondary (overlay) finish oil on the yarn (II FOY) was about 0.35% based on the weight of fiber. The wide-gauge Volkmann twister was run at 8000 rpm storage disc speed for a few hours. Observations made during the ply-twisting operation are reported in Table 3.

EXAMPLE 2

In this example, 1410 denier Du Pont type 696AS BCF nylon carpet yarn was prepared with a secondary finish formulation containing a mixture of alkyl polyoxyalkylene carboxylate esters of the formula:

$$R_1-O-X_n-(CH_2)_m-\overset{\overset{\displaystyle O}{\|}}{C}-O-R_2 \qquad (I)$$

The secondary finish formulation contained 50% by weight of the above compound (I), where $R_1$ was $C_{18}$ alkyl, X was $-C_2H_4O-$, n was 5, m was 1, and $R_2$ was methyl, and 50% of the above compound (I), where $R_1$ was a mixture of $C_8$ and $C_{10}$ alkyl, X was $-C_2H_4O-$, n was 9, m was 1, and $R_2$ was methyl. The levels of secondary (overlay) finish oil (II FOY) were measured on two separate yarn samples and were respectively found to be about 0.6% and 0.9% based on the weight of fiber. The wide-gauge Volkmann twister was run at 8000 rpm storage disc speed for a few hours. Observations made during the ply-twisting operation are reported in Table 3.

EXAMPLE 3

In this example, 1410 denier Du Pont type 696AS BCF nylon carpet yarn was prepared with a secondary finish containing a mixture of alkyl polyoxyalkylene carboxylate esters of the formula:

$$R_1-O-X_n-(CH_2)_m-\overset{\overset{\displaystyle O}{\|}}{C}-O-R_2 \quad (I)$$

The secondary (overlay) finish formulation contained 80% by weight of the above compound (I), where $R_1$ was $C_8$ alkyl, X was $-C_2H_4O-$, n was 5, m was 1, and $R_2$ was methyl, and 20% by weight of the above compound (I), where $R_1$ was a mixture of $C_{18}$ and $C_{16}$ alkyl, X was $-C_2H_4O-$, n was 5, m was 1, and $R_2$ was methyl. The level of secondary (overlay) finish oil on the yarn (II FOY) was about 0.4% based on the weight of fiber. The wide-gauge Volkmann twister was run at 8000 rpm storage disc speed for a few hours. Observations made during the ply-twisting operation are reported in Table 3.

EXAMPLE 4

In this example, 1410 denier Du Pont type 696AS BCF nylon carpet yarn was prepared with a secondary finish containing a mixture of a conventional ethoxylate lubricant and an alkyl polyoxyalkylene carboxylate ester of the formula:

$$R_1-O-X_n-(CH_2)_m-\overset{\overset{\displaystyle O}{\|}}{C}-O-R_2 \quad (I)$$

The secondary (overlay) finish formulation contained 80% by weight of the above compound (I), where $R_1$ was $C_{18}$ alkyl, X was $-C_2H_4O-$, n was 5, m was 1, and $R_2$ was methyl, and 20% of PEG 352 Lauryl alcohol ether, available from Henkel Corp., as "Trycol" 5963. The level of secondary (overlay) finish oil on the yarn (II FOY) was about 0.4% based on the weight of fiber. The wide-gauge Volkmann twister was run at 8000 rpm storage disc speed for a few hours. Observations made during the ply-twisting operation are reported in Table 3.

EXAMPLE 5

In this example, 1410 denier Du Pont type 696AS BCF nylon carpet yarn was prepared with a secondary finish containing a mixture of a conventional ethoxylate lubricant and alkyl polyoxyalkylene carboxylate esters of the formula:

$$R_1-O-X_n-(CH_2)_m-\overset{\overset{\displaystyle O}{\|}}{C}-O-R_2 \quad (I)$$

The secondary (overlay) finish formulation contained 25% by weight of the above compound (I), where $R_1$ was $C_{18}$ alkyl, X was $-C_2H_4O-$, n was 5, m was 1, and $R_2$ was methyl, 25% of the above compound (I), where $R_1$ was $C_8$ alkyl, X was $-C_2H_4O-$, n was 5, m was 1, and $R_2$ was methyl, and 50% PEG 352 Lauryl alcohol ether, available from Henkel Corp., as "Trycol" 5963. The level of secondary (overlay) finish oil on the yarn (II FOY) was about 0.35% based on the weight of fiber. The wide-gauge Volkmann twister was run at 8000 rpm storage disc speed for a few hours. Observations made during the ply-twisting operation are reported in Table 3.

TABLE 3

(OBSERVATIONS DURING PLY-TWISTING)

| EXAMPLE | | TWISTING SPEED @ 8000 rpm |
|---|---|---|
| Ex. 1 | II FOY 0.35% | no broken filaments, no deposits |
| Ex. 2 | II FOY 0.6% | no broken filaments, no deposits |
| Ex. 2 | II FOY 0.9% | no broken filaments, no deposits |
| Ex. 3 | II FOY 0.4% | no broken filaments, no deposits |
| EX. 4 | II FOY 0.4% | no broken filaments, no deposits |
| EX. 5 | II FOY 0.35% | no broken filaments, no deposits |

We claim:

1. In a process for ply-twisting nylon bulked continuous filament yarns, comprising the steps of:
   a) feeding a creel nylon yarn through a tensioning device and onto a storage disc rotating at a speed of at least about 6000 rpm, whereby the yarn emerges from the disc and forms a balloon;
   b) contacting the yarn in the balloon with a balloon limiter as the yarn passes from the disc to a guide; and
   c) feeding a bucket nylon yarn through a separate tensioning device where the creel yarn exits from the balloon and wraps around the bucket yarn to form a ply-twisted yarn;

the improvement comprising, applying to the creel and bucket yarns from about 0.3 to about 1.0% by weight of a finish oil comprising a compound having the general formula:

$$R_1-O-X_n-(CH_2)_m-\overset{\overset{\displaystyle O}{\|}}{C}-O-R_2$$

where, $R_1$ is an alkyl chain from 12 to 22 carbon atoms;

n is 3 to 7; m is 1 to 3;

X is $-C_2H_4O-$ or a mixture of $-C_2H_4O-$ and $-C_3H_6O-$; and $R_2$ is an alkyl chain from 1 to 3 carbon atoms.

2. The process of claim 1, wherein the creel yarn is fed through a series of low-friction guide rollers prior to the storage disc.

3. The process of claim 1, wherein the speed of the storage disc is at least about 7000 rpm.

4. The process of claim 3, wherein the speed of the storage disc is about 8000 rpm.

5. The process of claim 1, wherein about 0.3 to about 0.7% by weight of finish is applied.

6. The process of claim 1, wherein X is $-C_2H_4O-$.

7. The process of claim 1, wherein X is a mixture of $-C_2H_4O-$ and $-C_3H_6O-$.

8. The process of claim 1, wherein the speed of the storage disc is at least about 7000 rpm and about 0.3 to about 0.7% by weight of the finish comprising the compound having the general formula:

$$R_1-O-X_n-(CH_2)_m-\overset{\overset{\displaystyle O}{\|}}{C}-O-R_2$$

where, $R_1$ is an alkyl chain from 16 to 18 carbon atoms;

n is 5; m is 1;

X is $-C_2H_4O-$; and $R_2$ is methyl is applied to the creel and bucket yarns.

9. The process of claim 1, wherein the nylon yarns are nylon 6,6.

10. The process of claim 1, wherein the nylon yarns are nylon 6.

11. In a process for ply-twisting nylon bulked continuous filament yarns, comprising the steps of:

a) feeding a creel nylon yarn through a tensioning device and onto a storage disc rotating at a speed of at least about 6000 rpm, whereby the yarn emerges from the disc and forms a balloon;

b) contacting the yarn in the balloon with a balloon limiter as the yarn passes from the disc to a guide; and c) feeding a bucket nylon yarn through a separate tensioning device where the creel yarn exits from the balloon and wraps around the bucket yarn to form a ply-twisted yarn;

the improvement comprising, applying to the creel or bucket yarn from about 0.3 to about 1.0% by weight of a finish oil comprising a compound having the general formula:

$$R_1-O-X_n-(CH_2)_m-\overset{\overset{\displaystyle O}{\|}}{C}-O-R_2$$

where, $R_1$ is an alkyl chain from 12 to 22 carbon atoms;

n is 3 to 7; m is 1 to 3;

X is $-C_2H_4O-$ or a mixture of $-C_2H_4O-$ and $-C_3H_6O-$; and $R_2$ is an alkyl chain from 1 to 3 carbon atoms.

12. The process of claim 11, wherein the finish is applied to the creel yarn.

13. The process of claim 11, wherein the finish is applied to the bucket yarn.

14. A ply-twisted nylon bulked continuous filament yarn produced according to the process of claim 1.

* * * * *